United States Patent [19]

Greive et al.

[11] 4,163,357

[45] Aug. 7, 1979

[54] APPARATUS FOR CABLE-TWISTING TWO YARNS

[75] Inventors: Aloys Greive, Münster; Aloys Horstmann, Greven, both of Fed. Rep. of Germany

[73] Assignee: Hamel GmbH, Zwirnmaschinen, Münster, Fed. Rep. of Germany

[21] Appl. No.: 899,735

[22] Filed: Apr. 25, 1978

Related U.S. Application Data

[63] Continuation-in-part of Ser. No. 886,802, Mar. 15, 1978.

[30] Foreign Application Priority Data

Jun. 13, 1977 [DE] Fed. Rep. of Germany ..... 2726603
Dec. 21, 1977 [DE] Fed. Rep. of Germany ..... 2757138

[51] Int. Cl.[2] ..... D01H 13/04; D01H 7/88; D02G 3/38

[52] U.S. Cl. ..... 57/58.36; 57/58.3; 57/352; 242/131.1

[58] Field of Search ..... 57/3, 6, 13, 14, 16, 57/17, 18, 34 R, 58.49, 58.52, 58.7, 58.83, 106, 58.3, 58.36, 59, 66; 242/130, 131, 131.1, 139

[56] References Cited

U.S. PATENT DOCUMENTS

| | | | |
|---|---|---|---|
| 1,778,284 | 10/1930 | Swanson | 242/131.1 X |
| 2,209,203 | 7/1940 | Kahlisch | 242/131.1 |
| 2,914,903 | 12/1959 | Klein | 57/58.36 X |
| 2,949,725 | 8/1960 | Renzini | 57/58.36 |
| 3,625,453 | 12/1971 | Furst | 242/131 |
| 3,935,698 | 2/1976 | Lesnik | 57/18 |
| 3,981,128 | 9/1976 | Munker | 57/106 X |
| 4,047,372 | 9/1977 | Horstmann et al. | 57/106 X |

FOREIGN PATENT DOCUMENTS

| | | | |
|---|---|---|---|
| 1267047 | 6/1961 | France | 57/127.5 |
| 2261360 | 9/1975 | France | 57/18 |

*Primary Examiner*—Donald Watkins
*Attorney, Agent, or Firm*—Karl F. Ross

[57] ABSTRACT

An apparatus for twisting a first and second yarn having a parallelogrammatic mounting support for a plurality of supplies of one of said yarns mounted above a twisting spindle carrying the other of said yarns and having a radially open aperture, a takeup means mounted above said twisting spindle, and a U-shaped guide for passing said one of said supplies of yarn from the mounting support to said spindle.

25 Claims, 11 Drawing Figures

APPARATUS FOR CABLE-TWISTING TWO YARNS

CROSS-REFERENCE TO RELATED APPLICATION

This application is a continuation-in-part of the commonly owned and copending application Ser. No. 886,802 filed Mar. 15, 1978.

FIELD OF THE INVENTION

The present invention relates to a yarn-twisting apparatus. More particularly this invention concerns a threading arrangement for such an apparatus.

BACKGROUND OF THE INVENTION

A standard twisting machine supports one or two yarn supplies normally constituted as yarn packages nonrotatable about a spindle axis. The yarn is pulled off the package, down through the spindle and pulled out through radially open holes at the base of the spindle adjacent a storage drum. This spindle and the storage drums are rotated at high speed and the yarn is pulled around the yarn supply to form a so-called balloon. The amount of twist imparted to the yarn is a function of the takeup speed at a takeup spool normally mounted above the yarn supply and rotated at a peripheral speed equal to the takeup speed, and the rotation speed of the spindle.

It has been known to adapt such a machine for a so-called cabling operation whereby two separate yarns, which may be of opposite twist, are wound cable-fashion around each other. Thus in the above-described type of machine the yarn supported on the spindle is not drawn down through the spindle but is drawn directly up through the takeup eye that is normally provided immediately above the spindle on the spindle axis. Another yarn is fed to the lower end of the spindle which is normally tubularly hollow, and is drawn out through the above-mentioned aperture adjacent the storage drum. This second yarn is drawn up around the package of the first yarn and through the same takeup eye. Rotation of the spindle at high speed therefore twists the yarns about each other to form a so-called double yarn of the cable type which is very useful in high-strength applications such as in carpets.

Such a machine therefore requires two separate yarn supplies. As the basic machine is a standard spinning or twisting apparatus, a separate creel is typically provided for the second yarns that are cabled around the first yarns. In most applications the second creel is provided next to but spaced by a gangway from the machine having the first yarns and the takeup spools. Each of the second yarns is led through a relatively long path beneath the gangway to the bottom of the twisting machine.

This arrangement has the considerable disadvantage that it takes up a great deal of floor space. What is more it is an extremely difficult operation to thread a new second yarn into the machine should the supply of the second yarn run out. The operator of such a machine must also keep an eye out to both sides of the gangway, checking on the takeup spools, the packs of first yarn in the basic spinning machine, and the yarn supplies in the creel for the second yarns. Furthermore while tending the creel on one side or the twisting machine on the other the operator must turn his or her back to much of the machinery so that a considerable risk of unobserved malfunctioning exists.

With all such machines another considerable problem is that threading a new yarn in is a relatively complex operation. The yarn must be painstakingly fitted into various eyes or threaded through complex guides. The operation is often aided by means of a threading hook that must be poked down onto the machine at the balloon-forming structure to pick up the free end of a new yarn. In particular the difficulty of threading in a machine having a multispindle bank can lead to interference with adjacent spinners.

OBJECTS OF THE INVENTION

It is therefore an object of the present invention to provide an improved twisting apparatus.

Another object is the provision of such an apparatus which is capable of decabling operation as described above but which takes up substantially less floor space and which is substantially easier to tend than the prior-art machines.

Yet another object is to provide an improved such apparatus which is substantially easier to thread than the known devices.

SUMMARY OF THE INVENTION

These objects are attained according to the present invention in a machine of the above-described general type wherein the rotatable takeup spool is provided on the machine frame above the tubularly hollow spindle. A holder for the second yarn is supported for displacement on the frame of the machine between an operating position generally above the takeup spool and the spindle and a loading position below the operating position and next to the spool and spindle. A tubular U-shaped guide closed except at its upwardly open ends is provided on the frame between the holder for the second yarn and the spindle for feeding the second yarn from its supply on the creel into the lower end of the spindle. Another guide is provided for passing the yarn up past the supply of one yarn to the takeup spool. The spindle is driven to rotate it about its axis and thereby twist the yarns about each other and the takeup spool is similarly driven to wind the twisted-together yarns up. Means is provided for passing a current or stream of air or other gas through the U-shaped guide to pneumatically entrain the yarn during threading-in of a new filament.

Thus with the machine according to the instant invention the second yarns are not fed in a complex relatively long path across a gangway from a creel to the twisting machine, but are carried directly on the twisting machine above the respective supply of first yarn and twisting equipment. The machine according to the invention therefore can have a succession of stations at each of which is located all of the mechanism and supplies for each separate production unit. At a single glance the operator can determine whether there is sufficient yarn in each of the supplies at each station and how each of the twisters is operating. Whenever one of the supplies of the second yarn starts to run out it is relatively simple task for the operator to swing down the holder and add a new yarn package, without even stopping the twisting operation according to this invention, and if the supply runs out, it is a very easy task to thread a new yarn in pneumatically.

According to further features of this invention the holder for the supply of the second yarn is V-shaped and has a pair of arms lying at an angle of between 100° and 140°, normally 120°, to each other. Each such arm carries on its outer end a pin on which is mounted a respective package of the second yarn. Furthermore this entire unit is pivotal by means of a parallelogrammatic linkage between the above-mentioned operating and loading positions, lying all the time in an upright plane including the respective spindle axis. Thus even when swung down into the loading position against the force of a return biasing spring each of the holders still lies immediately next to the respective twisting apparatus. A pawl-type latch is provided which can lock the holder in the lower loading position during replacement of one of the yarn packages. The tail end of the yarn of one package is connected according to this invention to the leading or starting end of the yarn of the other package so that there is normally no need to shut the production unit down while loading in a new package of the second yarn.

According to further features of this invention the second yarn is guided from whichever package it is being pulled from through a first guide eye which lies in the above-described plane. It then passes generally perpendicularly to this plane through a short distance to a second such eye and then drops down and into the upwardly open upstream end of the U-shaped tube. Inside this tube the yarn passes down through the upright upstream leg of the tube, which is parallel to but offset from the above-mentioned plane, then down around the lower right portion of the tube, and finally up through the upright downstream leg of the tube to exit from the upright open downstream end thereof. Thus during its travel along a mainly vertical path from the yarn holder to the twister the second yarn is made to pass out of the way of most of the mechanism, and where it must run close to the mechanism extends through a tube which shields it. With this arrangement as the holder is pivoted down from the operating to the loading position the distance between the second guide eye and the top of the guide tube is shortened. Such shortening will have no disadvantageous effects on the operation of the machine if a thread brake is provided between the lower end of the tube and the lower end of the spindle for the second yarn. Another such thread brake may be provided at the second guide eye.

According to yet another feature of this invention each of the above-described pins of the holder for the second yarn may be pivotal out of the operating plane of the respective production unit for loading of a new package onto the holder. Such lateral pivoting makes it a relatively simple operation to take off an empty yarn package core and place a new yarn package on the empty pin, securing the starting end of the yarn of the new package to the tail end of the other package. These two pins extend perpendicular to the respective arms and the above-mentioned first guide eye is provided at the intersection of their longitudinal axes.

In accordance with another feature of this invention the balloon-lamiting sleeve fixed on the frame and spacedly surrounding the spindle is provided with a downwardly tapered deflector having a lower edge below the radially open aperture of the spindle. Thus as the second yarn is blown up from the downstream end of the U-shaped guide tube into the lower end of the hollow spindle and passes, with the current of air carrying it, radially out through the aperture it will be deflected with the current of air up into the balloon space between the spindle and the sleeve. The operator of the device can then very easily catch the upwardly blown end of the new filament and manually thread it the rest of the way to the takeup spool. No threading hook need be employed.

The means for pneumatically entraining a new yarn through the U-shaped guide may be a pneumatic threading gun as shown in the commonly owned U.S. Pat. No. 4,047,472 having a slotted tip that can fit into the upstream end of the U-shaped tube. It is also possible in accordance with this invention to integrate an injector-type jet pump into the U-shaped tube and to provide at the spinner a valve for actuating the pump and forming a rapidly moving current or air passing downstream in the tube. With last-mentioned arrangement the operator need merely place the free end of a new yarn into the upstream end of the U-shaped tube, press the threading button, and then catch the thus entrained end at the spindle. Such an operation can be carried out very easily.

The machine according to the present invention therefore is extremely compact and easy to tend. Even though it carries several yarn supplies and indeed functions to produce a cable-type yarn which normally requires considerable machinery, it takes up no more floor space than the standard yarn-twisting machine. Each production unit is relatively narrow and adding the necessary structure to an existing twisting machine to give it a cabling capacity in no way increases the size horizontally of any of its production units, but merely increases the overall hieght of the assembly. During normal operation of the machine the yarn packages for the first yarn are well up out of the way, and need only be swung down for replacement of one of these packages.

SPECIFIC DESCRIPTION

Figure 1:
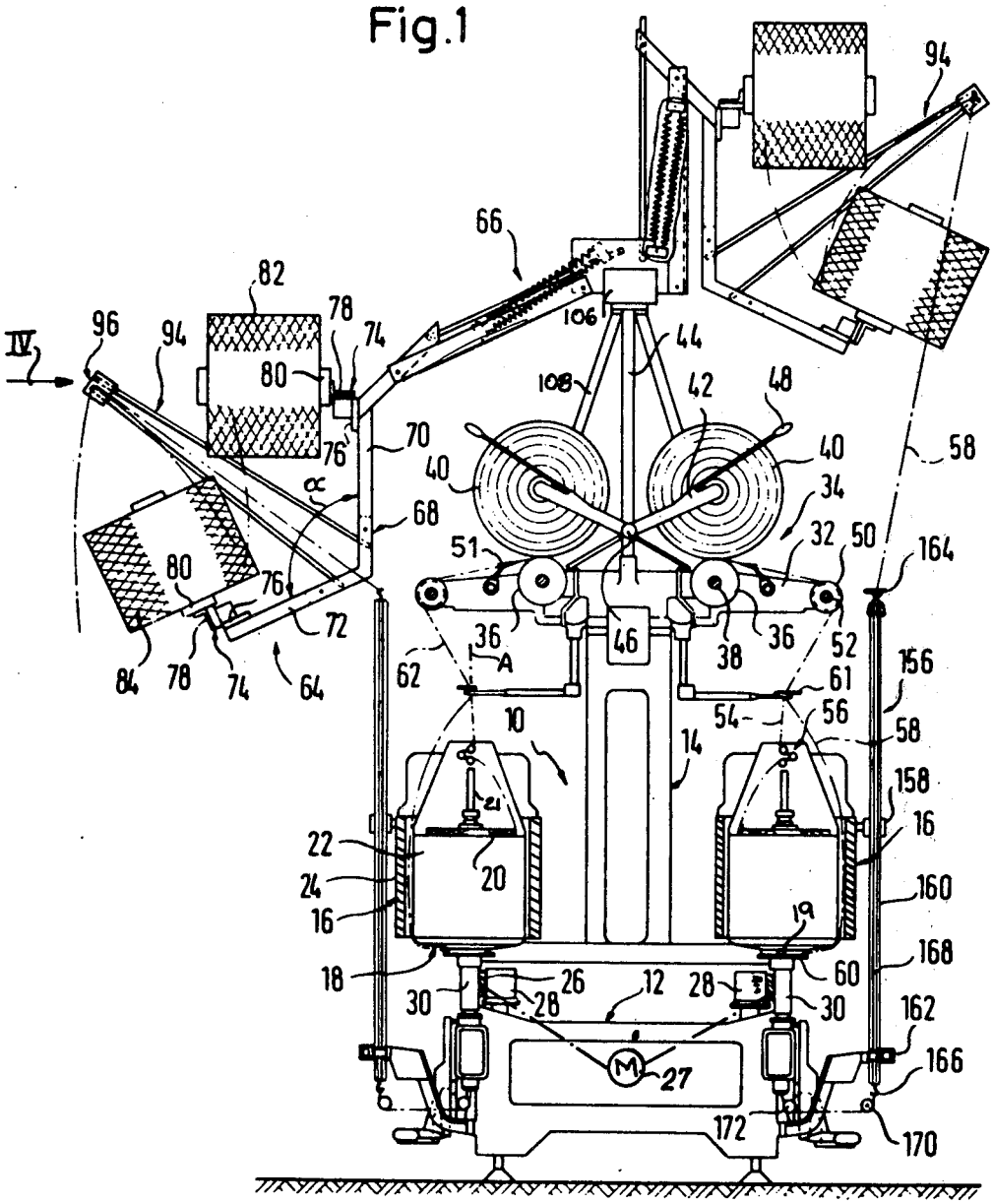
FIG. 1 is an end view of a machine according to this invention.
Figure 2:
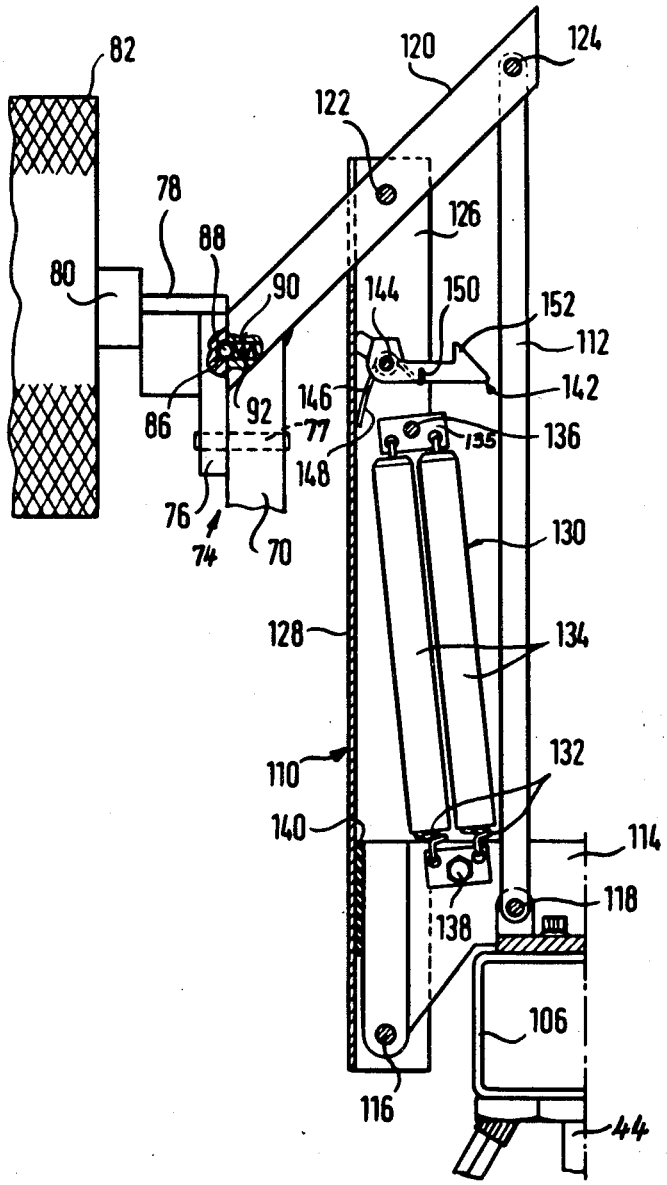
FIGS. 2 and 3 are large-scale end views of details of the apparatus of FIG. 1 in the operating and loading positions, respectively.
Figure 3:
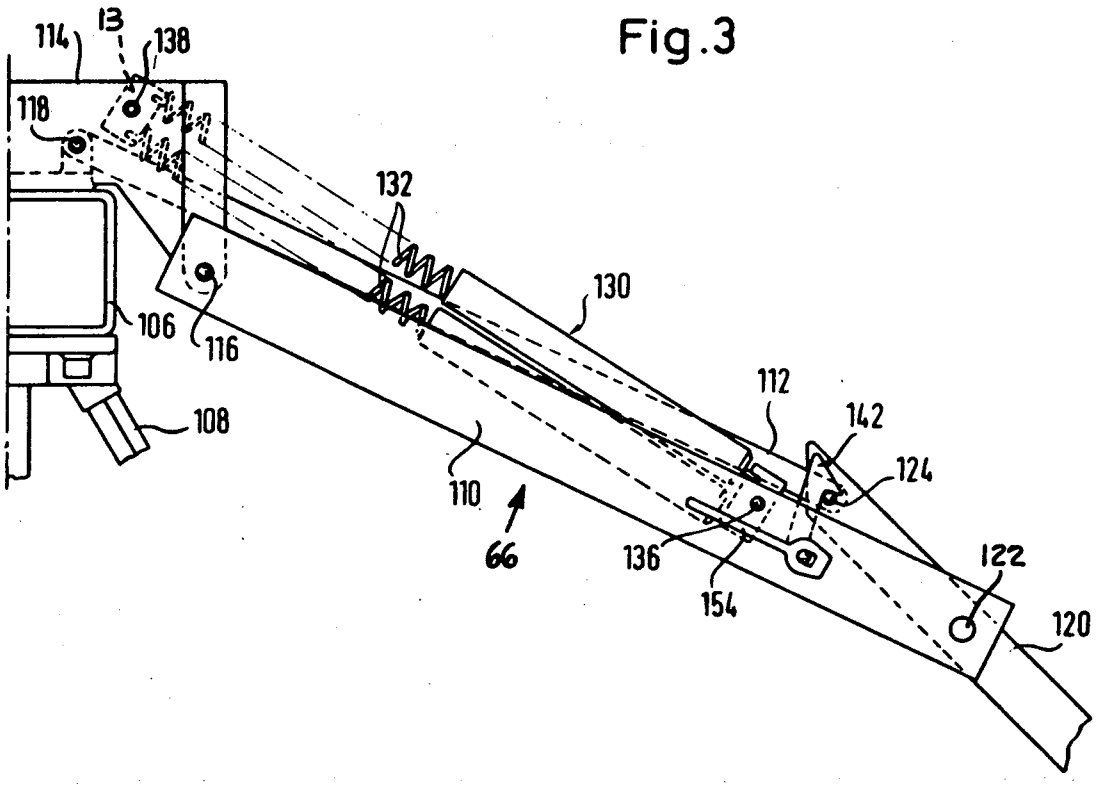

As shown in the drawing in FIGS. 1–4 the apparatus according to the invention basically comprises a frame 10 extending longitudinally in a direction perpendicular to the plane of view in FIGS. 1–3 and having a lower frame portion 12 and an intermediate portion 14. Two rows of twisters 16 are provided on this frame 10 at the lower portion 12 and immediately above each of the twisters 16 is a respective takeup device 34. Above each of the takeup devices in turn is a respective creel or second yarn supply 64. FIG. 1 shows two side-by-side production units each having a respective twister 16, takeup device 34, and creel 64. A gangway is provided to each longitudinal side of the frame 10.

Each twister 16 basically comprises a rotor 18 having a storage drum 60 formed with an aperture 19 and by a spindle 21 supported nonrotatably on the rotor 18 and carrying a yarn package 20 of a first yarn 54. Closely surrounding the yarn package 20 is a balloon-limiting sleeve 22 fixed to the rotor 18 and coaxially surrounding this cylindrical sleeve 22 is a wind-shiled sleeve 24 forming an annular cylindrical space therewith. The wind-shield sleeve 24 is fixed to the frame portion 12 and is therefore nonrotatable. Magnets coacting through nonmagnetic sleeve 22 with structure connected to the yarn package 20 prevent it from rotating as the rotor 18 turns at high speed. A drive belt 26 operated by a motor 27 is pressed by idler rollers 28 against whorls 30 formed at the bottom of the rotors 18.

A transverse beam 32 above each pair of twisters 16 supports the respective takeup devices 34. Each such device has a takeup drum 36 mounted on a shaft 38 extending parallel to the longitudinal direction of the machine and rotated at a predetermined speed by the motor 27. A takeup spool 40 frictionally engages the drum 38 and is carried on an arm 42 journaled at 46 on a post 44 extending upwardly from the intermediate portion 14 of the frame. A handle 48 connected to each of the arms 42 can be raised to lift the spool 40 off the continuously driven roller 38 for removal of a full spool.

In accordance with the invention the yarn 54 is pulled upwardly off the package 20 and through a three-roller thread brake 56 and thence through an eye 61 centered on the axis A about which the rotor 18 rotates. Thence the filament 54 passes over a deflecting yarn-guide roller 50 and through a tranversing yarn guide 51.

A second yarn 58 is combined as will be described below with the yarn 54 to form a cabled double yarn 62. It is noted that if this yarn 58 is not used the apparatus can be operated as a normal spinning machine with the yarn 54 being pulled from the pack 20, down through the spindle 21, thence out through the aperture 19 onto the storage disk or drum 60 and thence up through the space between the sleeves 24 and 22 to the eye 61. Indeed two packages 20 can be mounted on the spindle 21 for doubling of the yarn during twisting.

Figure 4:
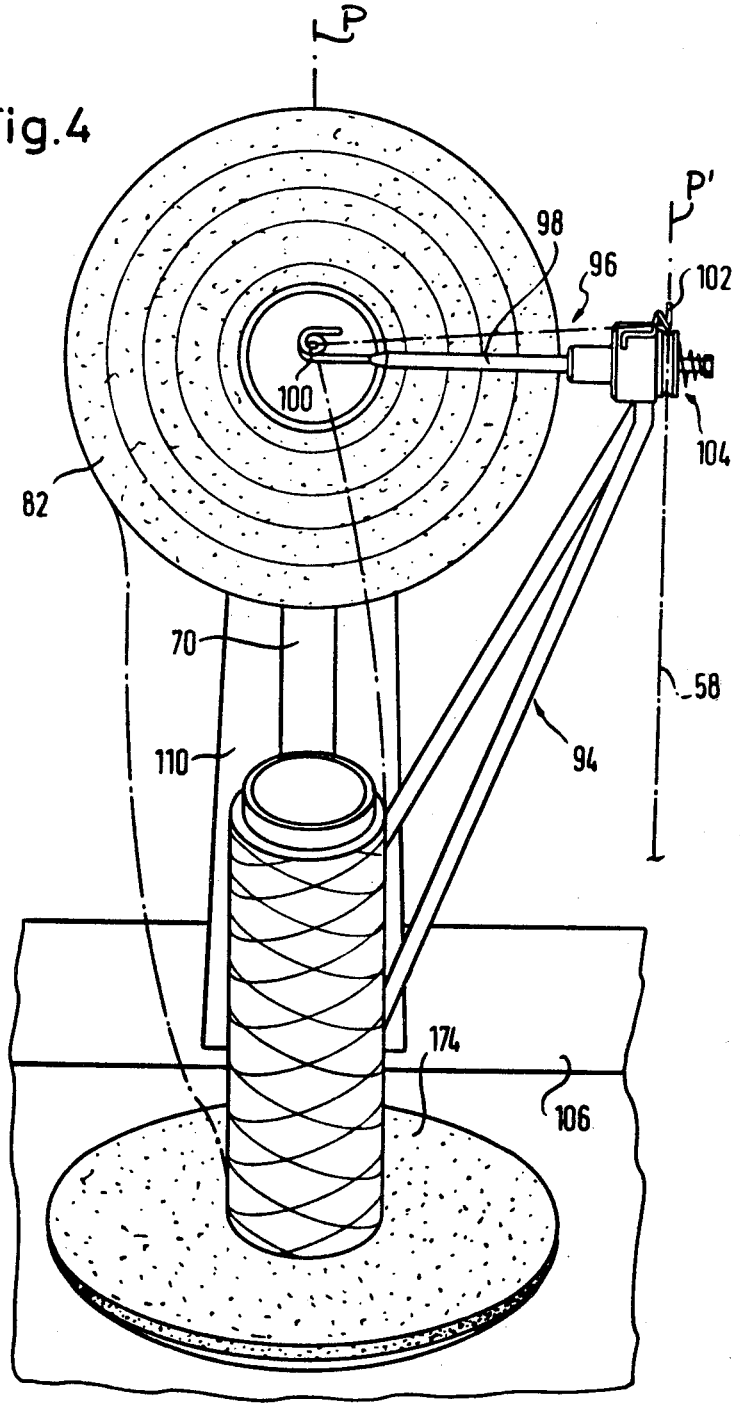
FIG. 4 is a large-scale view taken in the direction of arrow IV of FIG. 1.

As shown in more detail in FIGS. 2–4 provided above each twister 16 is a yarn holder 64 having a frame 68 and carried on a pivoting arrangement 66. The frame 68 is of V-shape and has a pair of arms 70 and 72 each carrying a respective mount 74 at its outer end. Each mount 74 as best shown in FIG. 2 comprises a base part 76 pivotal about a pin 77 on the respective arm and having a portion 78 on which is provided a mounting pin 80 for either or two yarn packages 82 and 84. The two pins or spindles 80 extend at an angle $\alpha$ of 120° to each other. In addition each mount 74 allows for pivoting of the respective yarn package about the axis pin 77 relative to the respective arm. A latching device in the form of a semispherical recess 66 formed in the part 76 and a cylindrical recess 90 carrying a ball 88 engageable in the recess under the force of a spring 92 is provided.

As shown in FIG. 4 the two arms 70 and 72 lie in a plane P which includes the axis A of the spindle 21 of the respective twister 16.

A pair of struts 94 extend upwardly from the arms 70 and 72 and carry at their upper end a thread-guide arrangement 96 constituted by a stem 98 on the inner end of which is provided a typical thread eye or guide 100 and on the outer end of which is provided another such thread guide or eye 102 and a standard spring-loaded thread brake 104. The eye 100 lies at the intersection of the axes of the pins or spindles 80 and in the plane P whereas the eye 1-2 lies outside of this plane P and indeed in a plane P′ parallel thereto but offset in the longitudinal direction of the machine.

At the upper ends of the posts 44 the machine carries a longitudinal beam 106 on which are supported the inner ends of the parallelogrammatic linkage 66 best shown in FIGS. 2 and 3. A pair of struts 108 extending downwardly from the beam 106 make the entire upper assembly very rigid on the frame 10 of the machine.

Each parallelogrammatic linkage comprises a pair of relatively long links 110 and 112 connected together at their inner ends at respective pivot pins 116 and 118 on a flange or inner link member 114 fixed to the beam 106. These pivot pins 116 and 118 are perpendicular to the planes P and spaced both vertically and horizontally perpendicular to the longitudinal direction of the machine. At their outer ends the two links 110 and 112 are pivoted at respective pivot pins 122 and 124 on an outer arm 120 whose outer end is welded or flanged to the outer end of the one leg 70 of the V-shaped holder frame 64. The link 110 is of U-section and has a pair of parallel flanges or legs 126 in which are journaled the pivot pins 116 and 122 and which flank and receive most of the structure of the parallelogrammatic linkage 66, and a web 128 interconnecting these two flanges 126.

A spring assembly 130 constituted by a pair of tension springs 132 received in respective shield tubes 134 has an end plate 135 pivoted at 136 between flanges 126 of the link 110 adjacent the pivot pin 122, and at the other end has another plate 137 secured at 138 above the pivot pin 118 and between the pivot pins 116 and 118 to the flange 114. This spring arrangement 130 normally biases the parallelogrammatic linkage 66 into the operating position of FIG. 2 from the loading position of FIG. 3. A bumper strip 140 is provided on the face of the flange 114 to engage the inner surface of the web 128 in the operating position so as to cushion return of the assembly to this operating position and to hold it snugly and vibrationless in place therein.

In order to lock the parallellogrammatic linkage in the loading position a hooked pawl 142 is pivoted at 144 on the link 110 at the flanges 126 thereof between the pivot pins 122 and 136. A torsion spring 146 has one leg 148 bearing on the web 128 and another leg 150 hooked over the pawl 142 to urge the hook 152 thereof over the pivot pin 124 between the links 112 and 120 in the working position. Thus when pulled down into this working position this spring-loaded pawl 142 will automatically snap over the pin 124 and hold the device in the working position. A lever 154 fixed to the pivot pin 144 allows the pawl 142 to be swung back and unhooked from the pin 124 so that the parallelogrammatic linkage 66 can automatically return to the operating position of FIG. 2.

From the yarn guide 102 and thread brake 104 of FIG. 4 the second yarn 58 is led down through a guide arrangement 156 fixed at clips 158 and 162 to the machine frame and constituted mainly by a vertical tube 160 lying in the plane P′. A yarn guide or eye 164 is provided at the top end of the tube 160 and another such guide or eye 166 at the bottom end thereof. The tube 160 is formed with a vertically and longitudinally throughgoing slit 168 to allow easy feeding of the yarn 58 into it. A roller-type thread brake 170 is provided below the eye 165 to guide the yarn from the eye 166 to another deflector roller 172 directly below the lower end of the respective spindle 21. Thus the rollers 170 and 172 deflect the yarn 58 back from the plane P' to the plane P.

The yarn 58 is led up through the hollow spindle 21 to the aperture 19 where it exits onto the storage drum 60 and then passes up through the balloon space between the sleeve 22 and 24. Thereafter the yarn 58 passes through the eye 61 where it is twisted around the yarn 54. The combined yarn 62 is then wound up onto the takeup spool 40 as described above.

Each of the yarn packages 80 and 81 has a respective core 174. Furthermore the tail end of the yarn on the one package 80 is tied to the starting end of the yarn on the other package 82. When one of the packages runs out therefore yarn continues to be fed from the other package. The operator in charge of the machine then grabs the frame 68 and pulls the entire creel arrangement down from the position shown above and to the right in FIG. 1 to the position shown to the left in FIG. 1. This brings the two spools 82 and 84 down to eye level so that the operator can easily pivot the pin 80 of the empty core 174 to the side and replace the empty core 174 with a new yarn package. The starting end of the yarn of the new package is tied to the tail end of the other package from which yarn can continue to be payed out.

Figure 5:
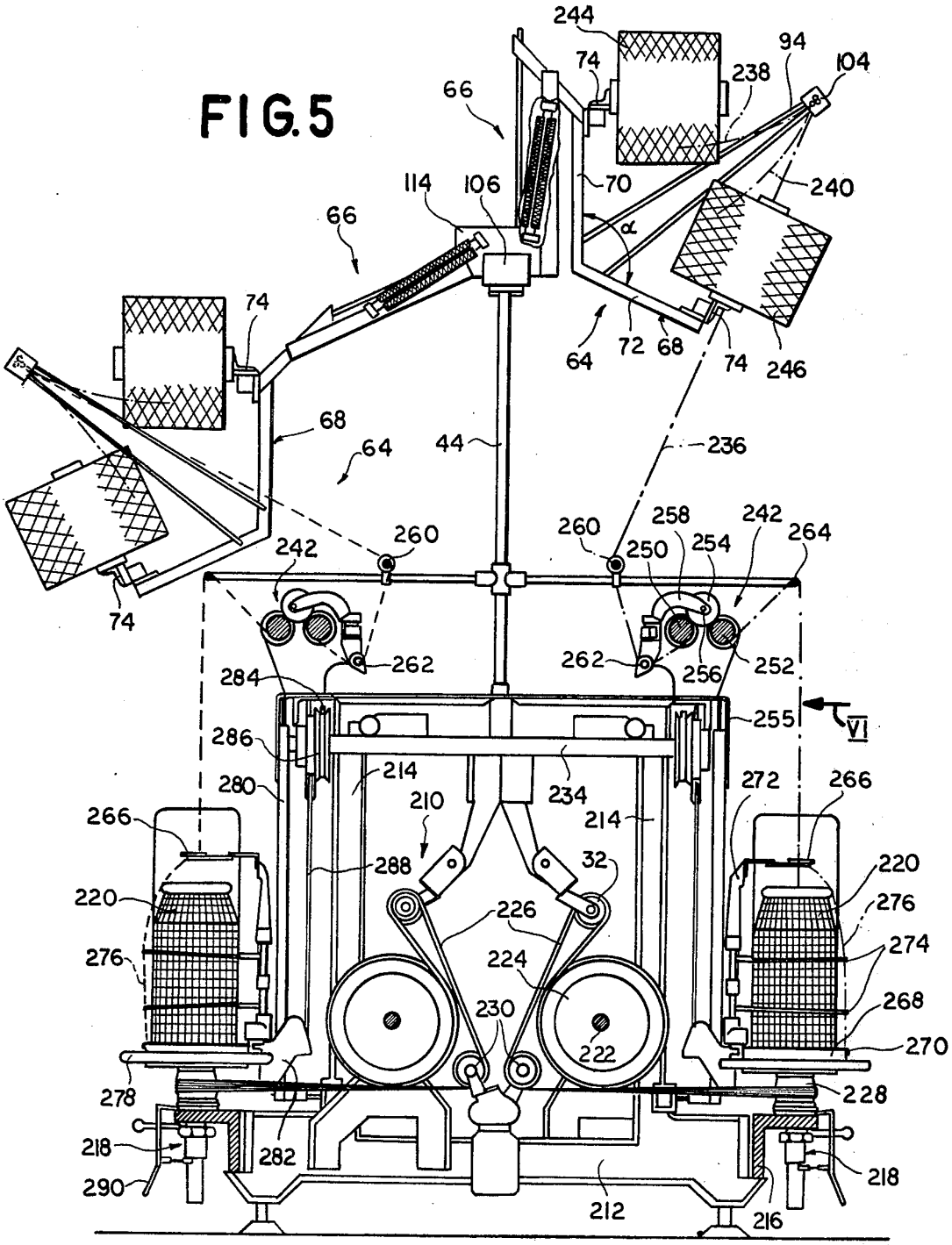
FIG. 5 is a view similar to FIG. 1 showing another twisting/cabling machine according to this invention.
Figure 6:
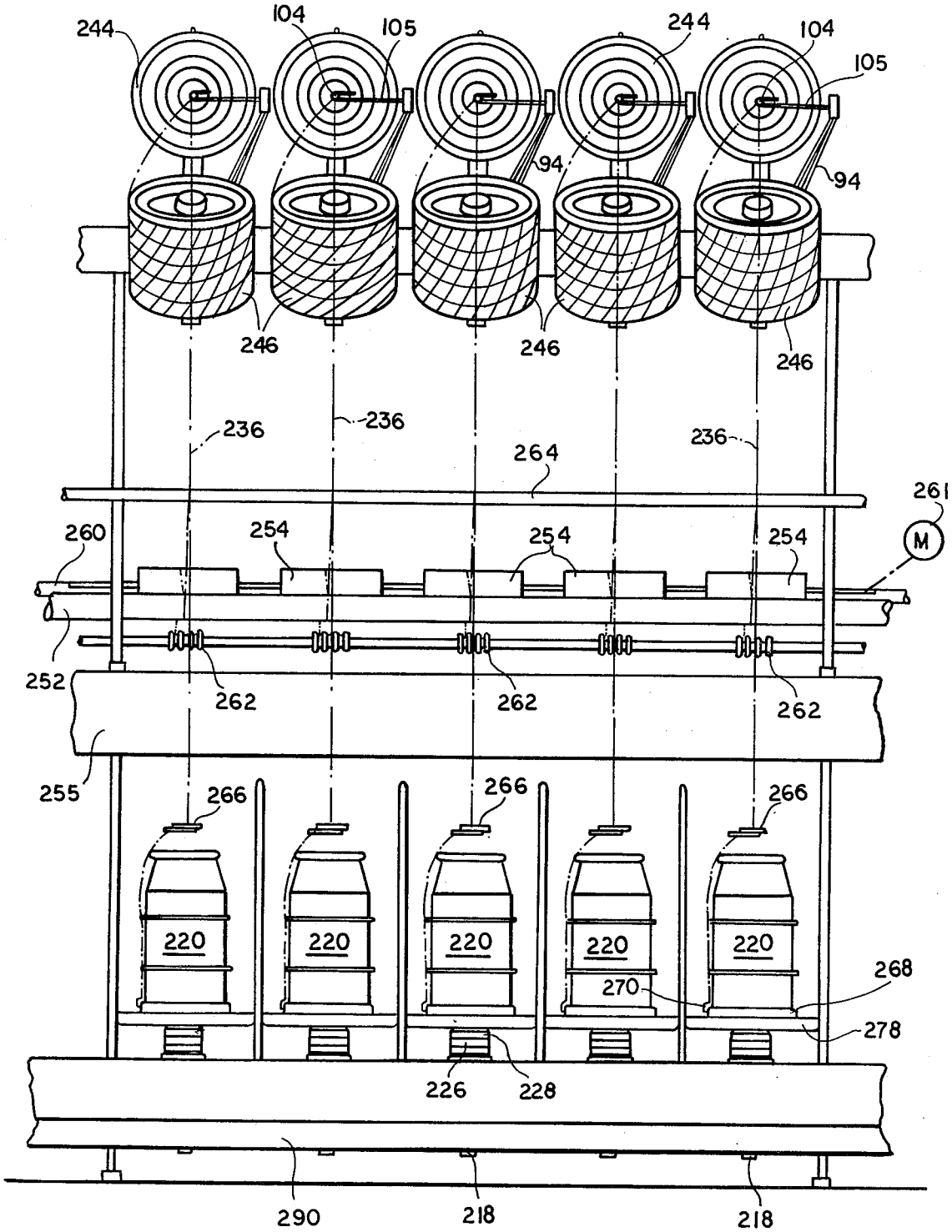
FIG. 6 is a view taken in the direction of arrow VI of FIG. 5.

In the arrangement of FIGS. 5 and 6 the same reference numerals as in FIGS. 1–4 are used for functionally identical structure.

Here the machine has a frame 210 having a lower frame 212 and an intermediate frame 214 supporting the center post 44. A longitudinally extending spindle back 216 has a plurality of upright spindles 218 which each support a takeup package 220 as best shown in FIG. 6.

A horizontal drive shaft 222 extends longitudinally along each spindle back 216 and carries a drive wheel 224 for each of the spinning spindles 218. A drive belt 226 reeved over each wheel 224 engages a whorl 228 of each spindle 218, passes over a deflector roller or wheel 230, and is tensioned by a spring-loaded wheel or roller 232.

Each holder or loader frame 68 carries a supply 244 of a first yarn 238 and a supply 246 of the second yarn 240 which are combined at the first guide and thread brake 104 to form a combined cabled yarn 236 that passes downwardly and around a shaft 260 passing longitudinally and horizontally past and above all of the spindles 218 and then under a respective guide 262 below the shaft 260. The cabled filament 236 then passes through a drive or feed device 242 comprised of a pair of lower rollers 250 and 252 both engaging another upper roller 254 carried on a common shaft 260 again passing longitudinally through the machine and carried on a shaft 256 driven by a motor 261. Thereafter the yarn 236 passes up and over another guide rod 264 again passing longitudinally along the machine and drops directly downwardly and axially through an eye 266 above and on the axis of the respective spindle 218. A longitudinal beam 255 extending along the machine and secured to the outer ends of a transverse beam 234 of the intermediate frame 212 supports these drive arrangements 242.

Each spindle 218 and its respective spool 220 is surrounded by a respective ring 268 having a traveler ring 270 through which the filaments 236 pass. A pair of balloon-limiting rings 274 carried on an upright 272 extending upwardly from a ring stand 278 confine the balloon 276 formed by the cabled yarns between the guide eye 266 and the traveler ring 270 as it orbits about the spindle 218.

Each ring stand 268 is carried on a slide shoe 282 vertically slidable along an upright rail 280 adjacent each spindle 218. A rotatable wheel 286 carried on the end of the transverse beam 234 is continuously engaged by a longitudinally continuously reciprocated drive element 285 and a flexible cable 288 wound on the wheel 286 can therefore vertically reciprocate and stroke the stand 278 as the element 284 is horizontally reciprocated. Thus the cabled filaments 236 are neatly wound up on the package 220.

Each spindle 218 is provided with a brake 290 that allows it to be rotationally arrested without stopping the respective drive shaft 222.

In this arrangement the two yarns 238 and 240 are drawn off the respective supplies 244 and 246 and combined right on the holder 64. They are then fed down as a double yarn 238 to the ring-spinning spindle 218 where they are wound up and simultaneously given the desired twist.

Figure 8:
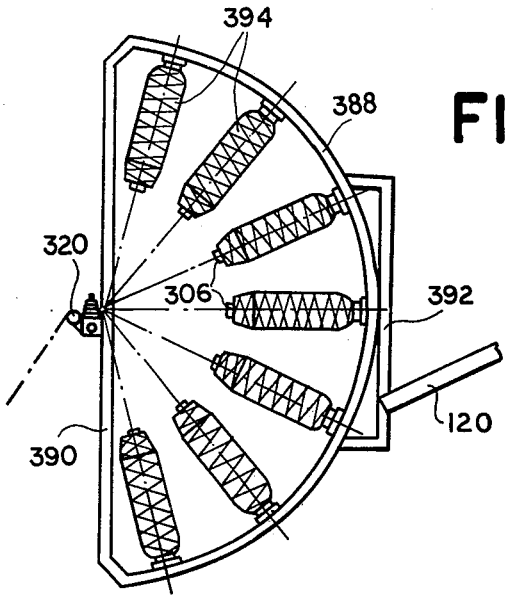
FIGS. 7 and 8 are views of other yarn-supply holders according to this invention.
Figure 7:
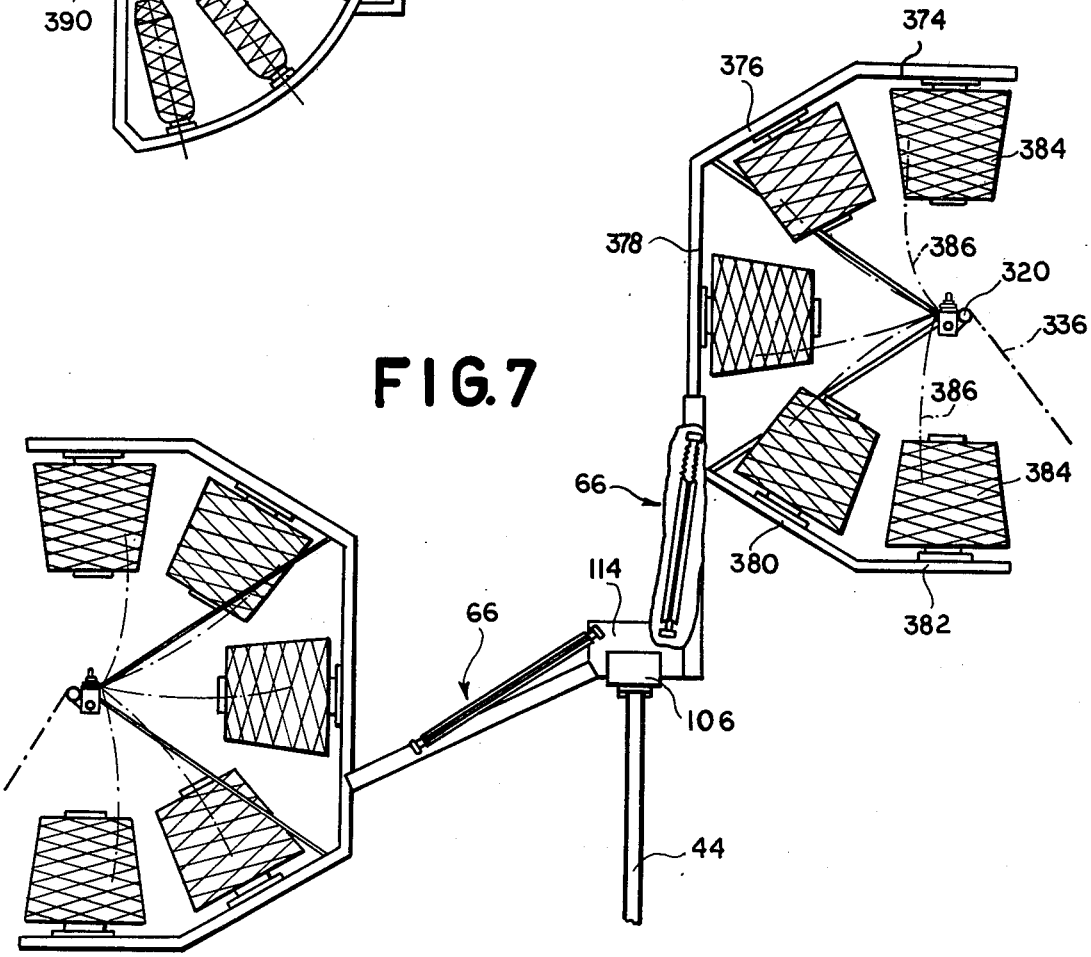

In FIGS. 7 and 8 arrangements are shown for carrying more than two yarn supplies. The arrangement of FIG. 7 allows four packages 384 each having a respective yarn 386 to be carried on a support having a large central arm 378 and at one end two further arms 374 and 376 and at the other end two further arms 380 and 382. The arms 374 and 382 are parallel to each other and perpendicular to the arm section 378. A thread brake 32 is provided at the center of this arrangement, mounted on a lateral arm 105 as shown in FIG. 5, and the combined filament 336 passes off as in FIGS. 5 and 6.

The arrangement of FIG. 8 simply allows a C-shaped frame 388 mounted on a support piece 392 and bridged by an end piece 390 carrying the thread brake 320 to carry seven packages 394 whose axes 306 all meet at the brake 320. In these last two arrangements even a relatively large creel can be serviced with ease. The operator of the machine can pull down the entire arrangement without interfering with the mechanism below it or risking injury.

During the entire operation of these machines, as in FIGS. 1–4, there is no need to shut the machine down as the mechanism being attended to lies completely out of the path of the yarn still being fed off. After the new package has been positioned the operator need merely flip the handle 154 to allow the spring arrangement 130 to pull the parallelogrammatic linkage 66 back into the operating position. In such a position the spools are completely out of the way and it is a relatively easy matter for the operator to attend to any of the other parts of the machine below it.

Figure 9:
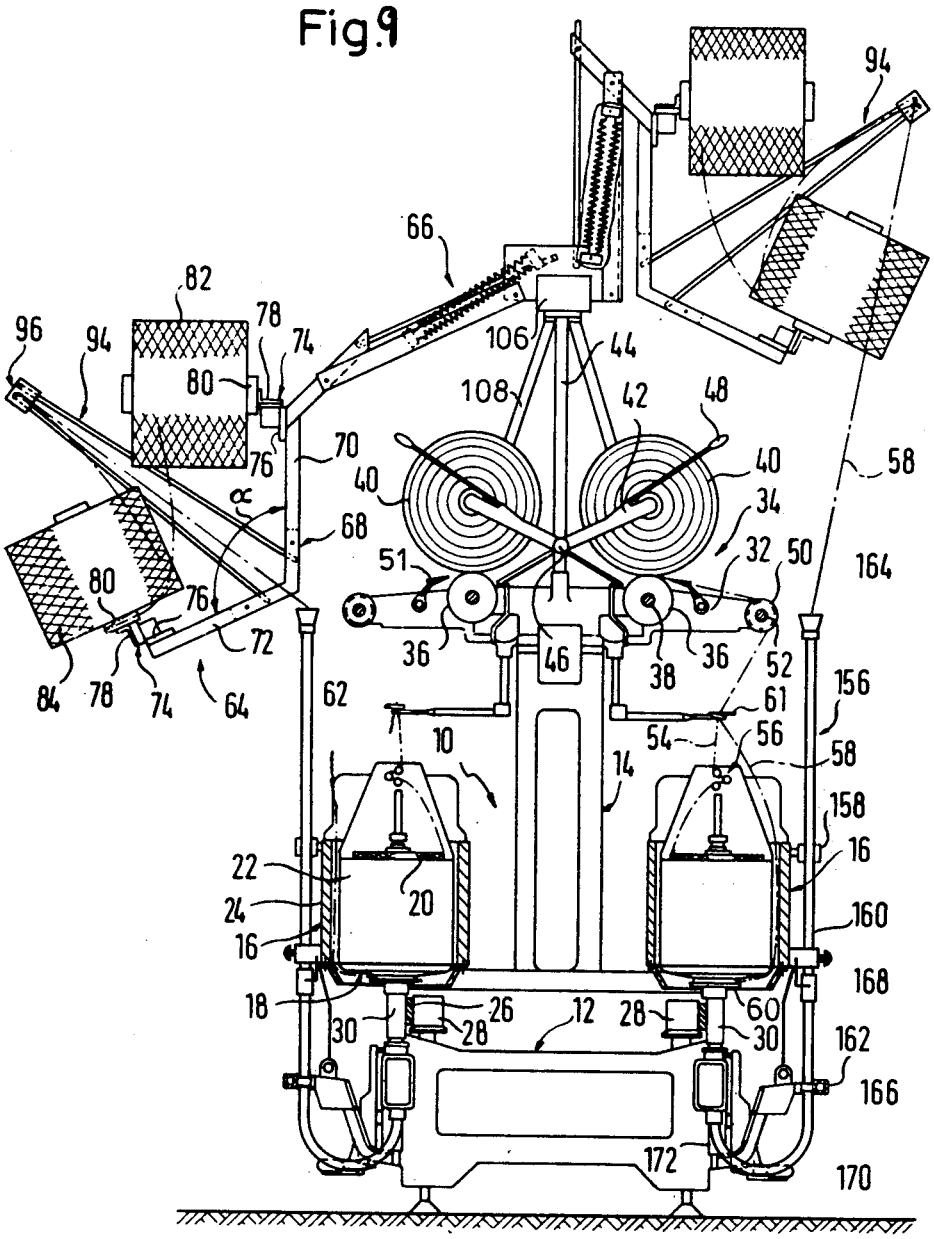
FIG. 9 is a view similar to FIG. 1 illustrating yet another machine according to the instant invention.

The arrangement of FIG. 9 is identical to that of FIG. 1 in all respects save relating to the yarn guide 156. Structure identical to that of FIG. 1 is identified with the same reference numerals.

Here, however, the guide 156 is replaced by a U-shaped guide tube 176 having an upstream leg 177 opening upwardly at an upstream end 178, a bight portion 179, and a downstream leg 180 opening upwardly at a downstream end 181. The clips 158 and 162 are secured to the long upstream leg 177 and the downstream leg 180 passes inwardly through the frame of the machine. The upstream leg 177 lies offset from the plane P but the downstream leg 180 lies in the respective plane P, and both legs 177 and 180 are parallel to each other.

A threading pistol or gun 195 connected to a compressed -air line 196 as described in the commonly owned U.S. Pat. No. 4,047,372 may be used in this arrangement to blow the filament or yarn 58 through the tube 176 and into the lower end of the hollow spindle 21, whence it will automatically extend out through the aperture 19.

Underneath the fixed sleeve 24 is a downwardly frusto-conical deflector ring 181 that will automatically deflect the yarn emerging from the hole 19 as well as the stream of air entraining it up through the space between the sleeves 22 and 24. Thus the entrained yarn will emerge upwardly from between the sleeves 22 and 24 so that the operator can grasp it and thread it through the eye 61 easily, without the use of a threading hook.

It is also possible according to this invention to provide an air valve 182 and jet pump 183 on the upstream leg 177 of the tube 176. A compressed-air line 184 extending along each side of the machine is connected via the valves 182 of the respective pumps 183.

Figures 10, 11:
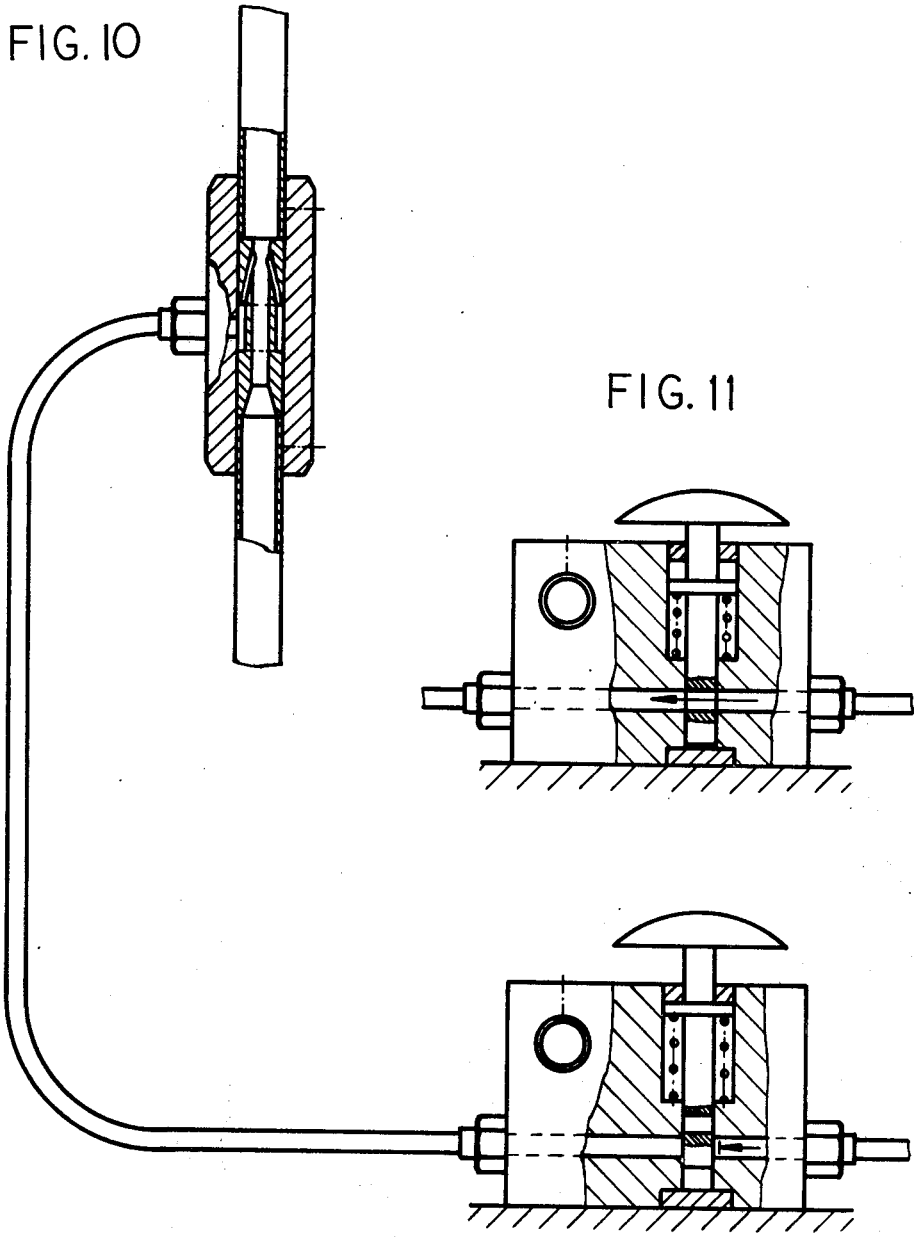
FIG. 10 is a large-scale and partly sectional view of a detail of FIG. 9.
FIG. 11 is a view similar to a detail of FIG. 10, but showing the structure in another position.
Figure 9:
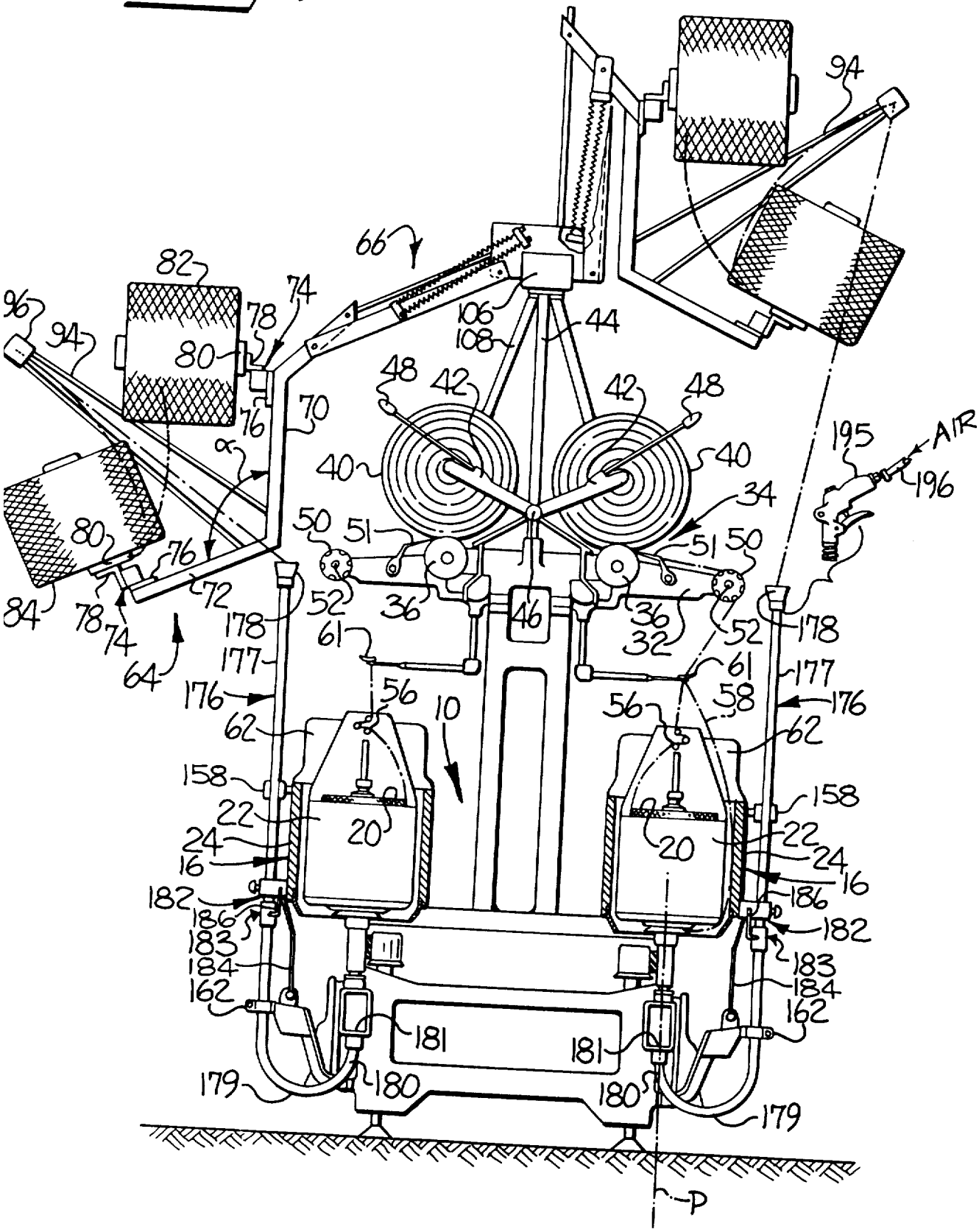
Figure 10:
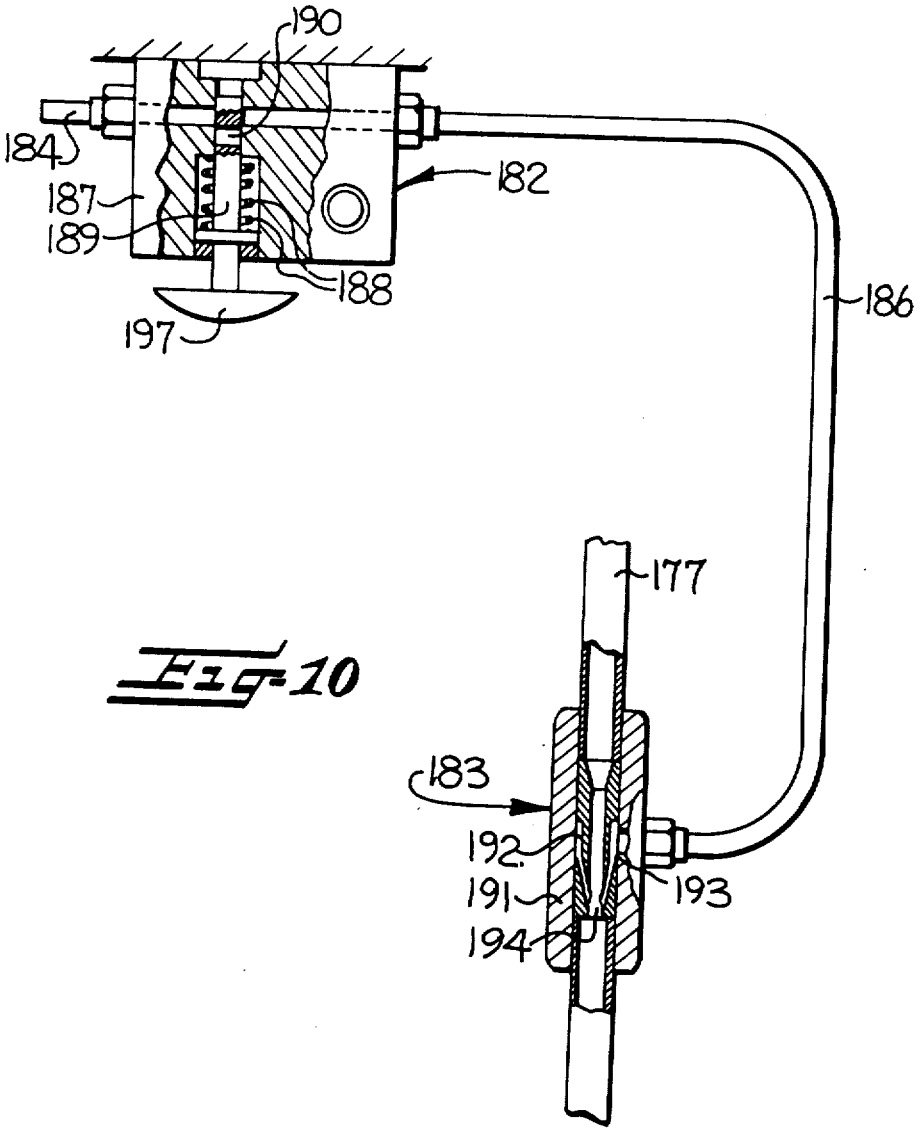
Figure 11:
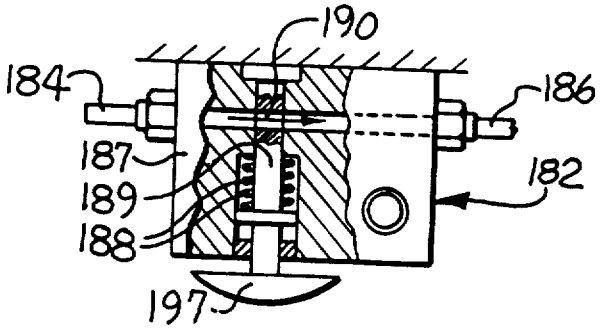

As best shown in FIGS. 10 and 11 each of the valves 183 is connected via a conduit 195 to the pressurized line 184 and via a line 186 to the respective pump 183. Each valve 183 has a housing 187 in which is displaceable against the force of a spring 188 a slider 189 formed with an aperture 190 alignable between the conduits 185 and 186 to interconnect same as shown in FIG. 11.

The pump 183 has a housing 191 forming an annular chamber 192 opening via at least three ports 193 to a restricted region 94. Thus compressed air issuing at high speed from the three ports 193 will cause gas to flow downwardly in the conduit leg 177.

To thread a new yarn into a machine thus equipped the operator need merely place the free end of such a new yarn into the upper end 178 of the tube 176 and then press the button 195 to open the valve 183. The free end will immediately be sucked into the tube 176 and entrained along it, eventually being expelled at the end 181 into the lower end of the spindle 21 and thereafter being deflected by the ring 181 up around the sleeve 22 as described above. The entire operation can be executed in seconds. Furthermore once the yarn is thus threaded it is completely protected by the closed tube 176 so that the possibility, for example, that the operator's clothing will come into contact with it in this critical region is completely eliminated.

We claim:

1. An apparatus for twisting together two yarns, said apparatus comprising:

a frame;

a tubular spindle having and rotatable on said frame about an upright spindle axis, said spindle having a support for a supply of one of said yarns and being formed below said support with a radially open aperture;

a rotatable takeup spool above said spindle on said frame said one yarn normally extending up from its supply and being engaged around said takeup spool;

a holder adapted to support a supply of the other of said yarns;

support means for displacement of said holder on said frame between an operating position generally above said takeup spool and said spindle and a loading position below said operating position and next to said spool and spindle;

guide means on said frame including a substantially closed U-shaped guide tube having an upstream end opening upwardly and directed toward said holder and a downstream end opening upwardly toward said spindle for feeding said other yarn from its supply into the lower end of said spindle, thence out through said aperture, and thence up past said supply of said one yarn to said takeup spool;

spindle drive means connected to said spindle for rotating same about said spindle axis and thereby twisting said yarns about each other;

takeup drive means for rotating said takeup spool and thereby winding the twisted yarns upon said takeup spool; and means for forming a stream of gas in said guide tube from said upstream end to said downstream end for pneumatically entraining and threading a filament therethrough.

2. The apparatus defined in claim 1 wherein said holder is supported on said support means pivotally and moves substantially in an upright plane on pivoting of said holder between said positions.

3. The apparatus defined in claim 2 wherein said support means is a parallelogrammatic linkage including a pair of generally parallel long links having inner ends pivoted at respective inner pivot axes on said frame and an outer transverse link carrying said holder, said long links having outer ends pivoted at respective outer pivot axes on said outer transverse link, said pivot axes all being substantially parallel and perpendicular to said plane.

4. The apparatus defined in claim 3, further comprising biasing means urging said linkage into said operating position.

5. The apparatus defined in claim 4 wherein said biasing means includes at least one spring connected between said frame and one of said links.

6. The apparatus defined in claim 4, further comprising means for latching said linkage releasably in said loading position.

7. The apparatus defined in claim 6 wherein said means for latching includes at least one pawl on one of said links pivotally operatively engageable with another of said links.

8. The apparatus defined in claim 7 wherein said linkage includes pivot pins at said pivot axes, said pawl being engageable over one of said pins and said means for latching further comprising spring means for urging said pawl into a position hookable over said one pin.

9. The apparatus defined in claim 8, further comprising a handle on said pawl operable for displacing same against the force of said spring means and out of said position hookable over said one pin.

10. The apparatus defined in claim 2 wherein said holder has a yarn guide between said supply of said other yarn and said guide means and displaceable substantially in said plane on displacement of said holder between said operating and loading positions.

11. The apparatus defined in claim 10 wherein said holder has a pair of support pins each adapted to carry a respective supply of said other yarn and including to each other, said yarn guide lying generally at the intersection of longitudinal axes of said pins, whereby the tail end of said other yarn of one of said supplies of said other yarn can be connected to the starting end of the other of said supplies of said other yarn.

12. The apparatus defined in claim 11 wherein said holder is generally V-shaped and has a pair of arms each having a respective outer end carrying a respective one of said pins, said pins and arms being generally coplanar and in said plane.

13. The apparatus defined in claim 12 wherein said apparatus has a row of such spindles, takeup spools, holders, and means in and defining a longitudinal direction, said plane being generally perpendicular to said direction and including said spindle axis.

14. The apparatus defined in claim 12 wherein said arms extend at an angle between 100° and 140° to each other.

15. The apparatus defined in claim 12, further comprising means for pivoting each of said pins between an inner position on said plane and an outer position offset from said plane.

16. The apparatus defined in claim 1 wherein said spindle is provided at said aperture with a storage drum.

17. The apparatus defined in claim 1 wherein said holder is level with said takeup spool in said loading position.

18. The apparatus defined in claim 1, further comprising an eye above said spindle on said spindle axis, both of said yarns passing through said eye before engaging said takeup spool.

19. The apparatus defined in claim 1 wherein said means for forming said stream of gas is a pneumatic threading pistol.

20. The apparatus defined in claim 1 wherein said means for forming said stream of gas includes an injector-type jet pump in said tube directed toward said downstream end therein.

21. The apparatus defined in claim 20 wherein said means for forming said stream includes a source of gas under pressure and a valve between said source and said jet pump.

22. The apparatus defined in claim 21 wherein said jet pump has an annular chamber surrounding said tube, a restriction in said tube, and at least one passage extending from said chamber toward said restriction and inclined to said tube at said restriction.

23. The apparatus defined in claim 20 wherein said tube has an upstream leg extending upwardly generally parallel to said spindel axis past said spindle, a downstream leg opening upwardly toward said spindle, and a bight portion between and interconnecting said legs.

24. The apparatus defined in claim 20 wherein said frame is provided with a sleeve spacedly surrounding said spindle and said holder of said one yarn and defining therewith a balloon space, said sleeve being provided with a downward deflector extension extending downwardly past said aperture.

25. The apparatus defined in claim 24 wherein said extension is downwardly frustoconical relative to said spindle axis.

* * * * *

UNITED STATES PATENT AND TRADEMARK OFFICE

CERTIFICATE OF CORRECTION

PATENT NO. : 4,163,357

DATED : August 7, 1979

INVENTOR(S) : Aloys Greive & Aloys Horstmann

It is certified that error appears in the above-identified patent and that said Letters Patent are hereby corrected as shown below:

In the drawings, Figures 9, 10 and 11 are corrected as shown on the attached two sheets of drawings.

In the specification; column 9, line 25, the reference numeral "183" should be -- 182 --; column 9, lines 25 and 26, the phrase "via a conduit 195 to the pressurized line 184 and" should be deleted; column 9, line 27, the reference numeral "183" should be -- 182 --; column 9, line 29, the reference numeral "185" should be -- 184 --; column 9, line 33, the reference numeral "94" should be -- 194 --; column 9, line 39, the reference numeral "195" should be -- 197 --.

Signed and Sealed this

*Seventh* Day of *January 1986*

[SEAL]

*Attest:*

*Attesting Officer*

DONALD J. QUIGG

*Commissioner of Patents and Trademarks*

Disclaimer 4,163,357.—*Aloys Greive,* Munster, and *Aloys Horstmann,* Greven, Germany. APPARATUS FOR CABLE-TWISTING TWO YARNS. Patent dated Aug. 7, 1979. Disclaimer filed Mar. 20, 1986, by the assignee, *Palitex Project-Co. GmbH.*

Hereby enters this disclaimer to the remaining term of said patent.

[*Official Gazette May 27, 1986.*]